US011050168B2

(12) United States Patent
Racho et al.

(10) Patent No.: US 11,050,168 B2
(45) Date of Patent: Jun. 29, 2021

(54) CRIMPING TERMINAL WITH WIRE HOOK TO LOOP WIRE

(71) Applicant: Lear Corporation, Southfield, MI (US)

(72) Inventors: Edgar Michael Racho, Lapu-Lapu (PH); Albert Cabanero, Cebu (PH)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/569,106

(22) Filed: Sep. 12, 2019

(65) Prior Publication Data

US 2021/0083403 A1 Mar. 18, 2021

(51) Int. Cl.
*H01R 4/18* (2006.01)
*H01R 43/048* (2006.01)
*H01R 4/26* (2006.01)

(52) U.S. Cl.
CPC ..... *H01R 4/185* (2013.01); *H01R 4/26* (2013.01); *H01R 43/048* (2013.01)

(58) Field of Classification Search
CPC .... H01R 4/18; H01R 4/183–185; H01R 4/16; H01R 4/26; H01R 43/04; H01R 43/048; H01R 43/042
See application file for complete search history.

(56) References Cited

U.S. PATENT DOCUMENTS

| | | | | |
|---|---|---|---|---|
| 4,842,534 | A | 6/1989 | Mobley et al. | |
| 5,474,475 | A | 12/1995 | Yamaguchi | |
| 7,652,552 | B2 | 1/2010 | Fussl et al. | |
| 9,088,079 | B2 * | 7/2015 | Kumakura | H01R 4/185 |
| 10,581,181 | B1 * | 3/2020 | Dix | H01R 4/185 |
| 2009/0269970 | A1 * | 10/2009 | Kumakura | H01R 43/0486 439/421 |
| 2011/0318960 | A1 * | 12/2011 | Koga | H01R 43/05 439/585 |
| 2017/0324184 | A1 * | 11/2017 | Lehner | H01R 13/17 |

* cited by examiner

*Primary Examiner* — Vanessa Girardi
(74) *Attorney, Agent, or Firm* — MacMillan, Sobanski & Todd, LLC

(57) ABSTRACT

An electrical terminal includes a conductor barrel and a contact portion that is adapted to mate with a corresponding terminal. A terminal base extends from the conductor barrel to the contact portion. The electrical terminal includes a first side wall and a second side wall that extend from the contact base between the conductor barrel and the contact portion. A wire hook extends between the first side wall and the second side wall. A first wire space is defined between the wire hook and the first side wall and a second wire space is defined between the wire hook and the second side wall.

7 Claims, 5 Drawing Sheets

CRIMPING TERMINAL WITH WIRE HOOK TO LOOP WIRE

BACKGROUND OF THE INVENTION

This invention relates to an electrical terminal. More specifically, this invention relates to an electrical terminal having an increased connection strength with a crimped wire.

An electrical terminal is used to create a connection between two electrical components. A crimped electrical terminal includes a crimp portion that is mechanically bent to engage a wire. An example of a crimped electrical terminal is described in U.S. Pat. No. 6,126,495, the disclosure of which is herein incorporated by reference. A typical crimped electrical terminal includes a rear connecting region that engages the wire. The rear connecting region includes crimp tongues that are bent to engage a conductor of the wire and crimp tabs that are bent to engage an insulator of the wire. This provides an electrical connection between the crimped electrical terminal and the conductor, as well as a mechanical connection between the crimped electrical terminal and the insulator. This mechanical connection prevents the wire from being pulled apart from the crimped electrical terminal during installation and use.

Conventional vehicles include an increasing number of electrical components that require an increasing number of electrical connections. As a result, wire harnesses in conventional vehicles include an increasing number of wires, which increases the weight of the wire harness. The weight of the wire harness can apply a force that tends to pull the wire out of the crimped electrical terminal. It would be advantageous to have a crimped electrical terminal having an increased strength crimped connection.

SUMMARY OF THE INVENTION

This invention relates to an electrical terminal. The electrical terminal includes a contact portion that is adapted to mate with a corresponding terminal. A terminal base extends from the contact portion. The electrical terminal includes a first side wall that extends from the contact base. The electrical terminal also includes a second side wall that extends from the contact base. A wire hook extends between the first side wall and the second side wall. A first wire space is defined between the wire hook and the first side wall and a second wire space is defined between the wire hook and the second side wall.

In other embodiments of the invention, the electrical terminal is part of an assembly that includes a wire conductor. A first leg of a wire conductor extends through the conductor barrel to a bend and is located on a first side of a wire hook. Additionally, a second leg of the wire conductor extends from the bend into the conductor barrel and is located on a second side of the wire hook, opposite the first side.

This invention also relates to a method of attaching an electrical terminal to a wire conductor. The method includes providing an electrical terminal with a wire barrel and a wire hook. The method also includes providing a wire conductor with a first leg that extends through the wire barrel and past the wire hook and a second leg that extends past the wire hook and into the wire barrel. The first leg and the second leg are separated by a bend. The method also includes crimping the electrical terminal so that the electrical terminal engages the wire conductor at the wire barrel, and the wire hook is located between the bend and the wire barrel.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
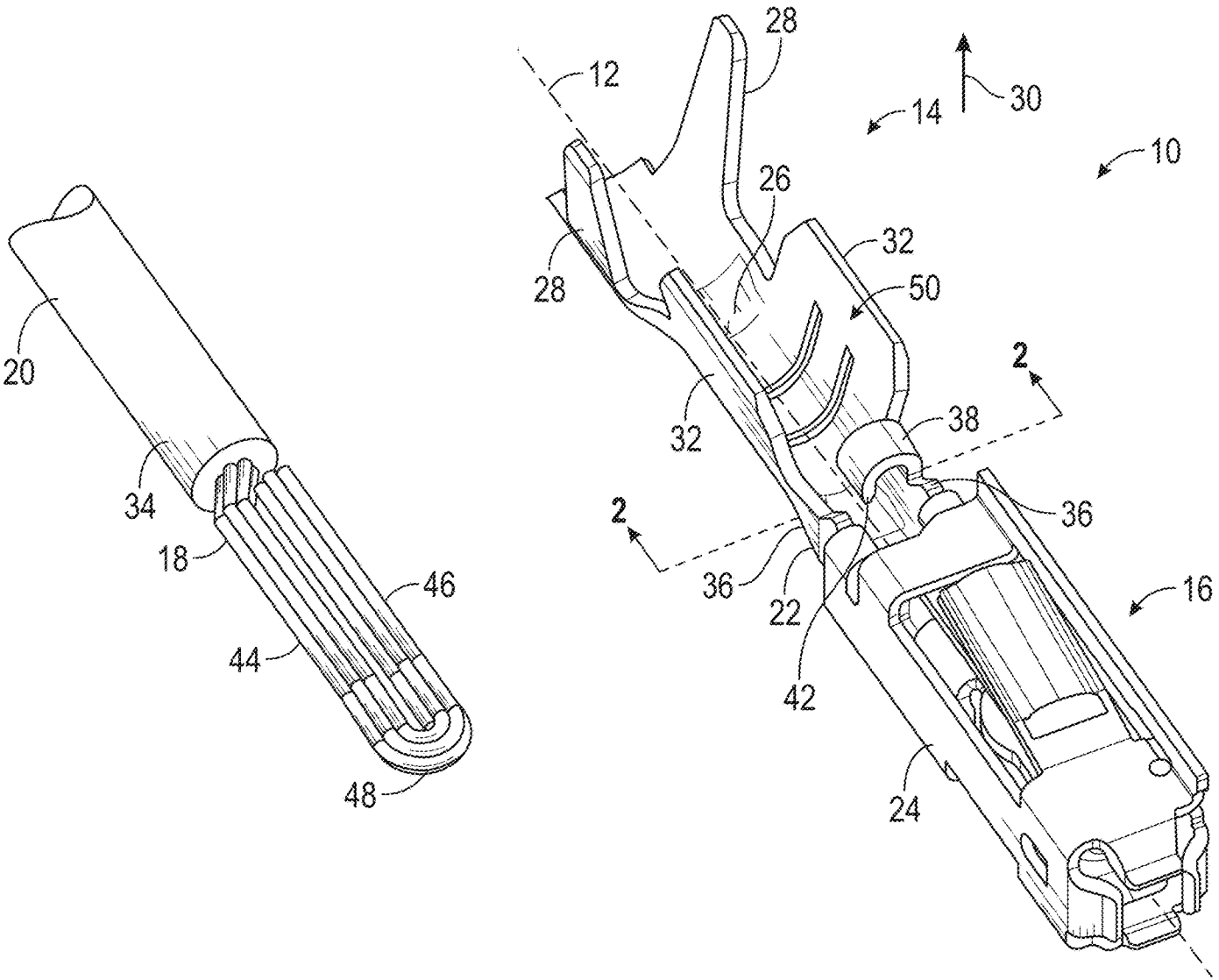
FIG. 1 is an exploded perspective view of an electrical terminal and a wire in accordance with this invention.

Referring now to the drawings, there is illustrated in FIG. 1 a perspective view of an electrical terminal, indicated generally at 10. The electrical terminal 10 includes many features similar to the plug-in contact described in U.S. Pat. No. 6,126,495, the disclosure of which is hereby incorporated by reference in its entirety. The illustrated electrical terminal 10 is a female terminal, but may be any desired type of terminal.

The electrical terminal 10 defines a terminal axis 12 and includes a connection portion, indicated generally at 14, and a contact portion, indicated generally at 16. The connection portion 14 is adapted to connect to an electrical conductor 18 of a wire 20. The illustrated connection portion 14 is adapted to be crimped onto the wire 20, but may be any desired type of connector. The contact portion 16 is adapted to mate with a corresponding terminal (not shown). The illustrated contact portion 16 is adapted to mate with a male terminal inserted along the terminal axis 12.

The illustrated electrical terminal 10 is a two-piece construction and includes a contact member 22 and a spring member 24. However, the electrical terminal 10 may include any desired number of components. The illustrated contact member 22 is made of copper, but may be made of any desired material. The illustrated contact member 22 is stamped and folded into the illustrated shape, but may be made by any desired process. The illustrated spring member 24 is made of stainless steel, but may be made of any desired material. The illustrated spring member 24 is stamped and folded into the illustrated shape, but may be made by any desired process.

The electrical terminal 10 includes a terminal base 26 that extends parallel to the terminal axis 12 through the connection portion 14. The illustrated terminal base 26 is part of the contact member 22, but may be any desired part of the electrical terminal 10. The terminal base 26 includes two crimp tabs 28 within the connection portion 14 that extend from the terminal base 26 generally in an outbound direction 30 and are located on opposed sides of the terminal axis 12. The crimp tabs 28 are adapted to be bent during a crimping process to engage an insulator 34 of the wire 20. The terminal base 26 also includes two crimp tongues 32 within the connection portion 14 that also extend from the terminal base 26 generally in the outbound direction 30 and are located on opposed sides of the terminal axis 12. The crimp tongues 32 are adapted to be bent during the crimping process to engage the conductor 18 of the wire 20.

Figure 2:
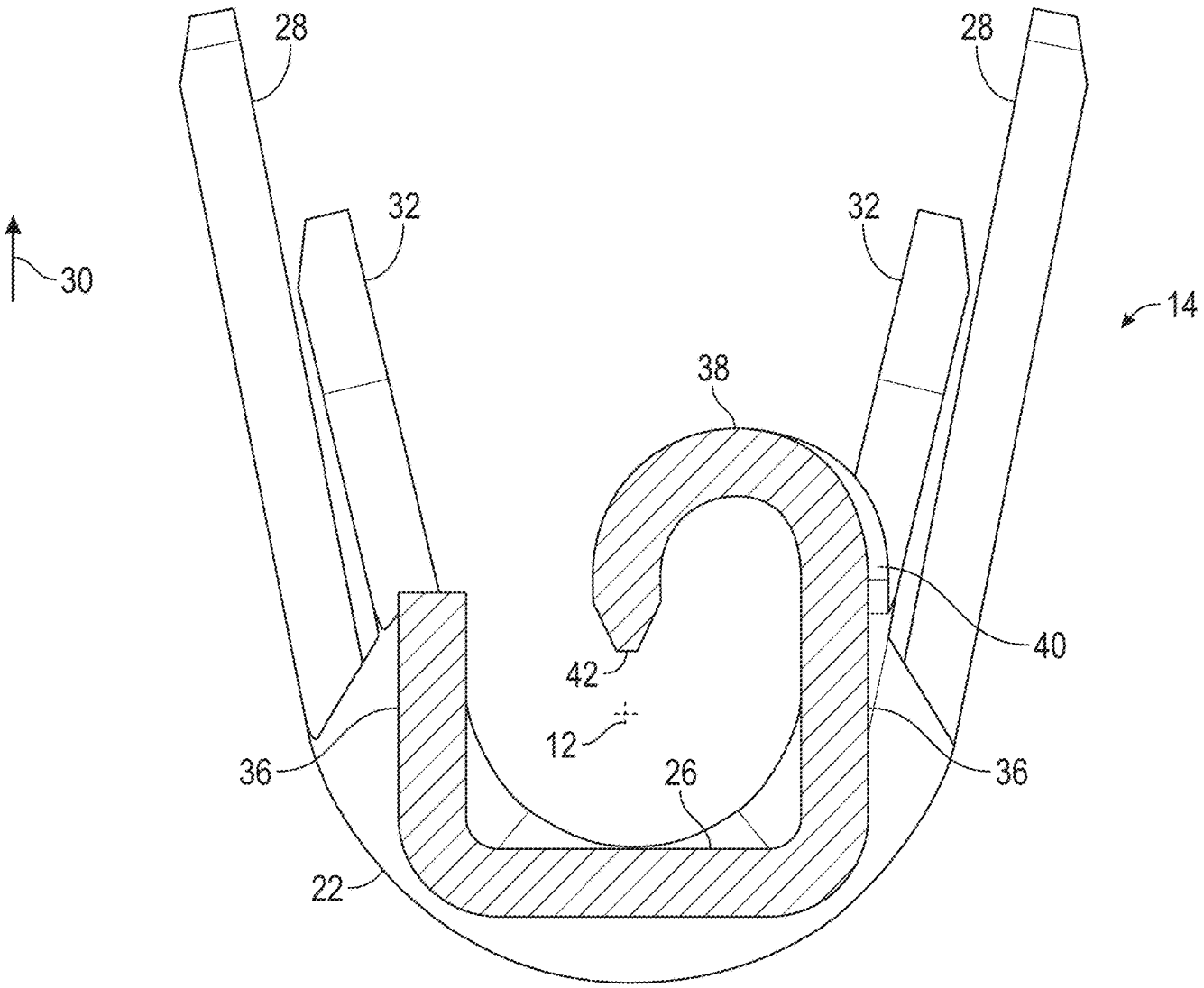
FIG. 2 is an enlarged cross-sectional view of the electrical terminal taken along the line 2-2 of FIG. 1.

Referring to FIG. 2, there is illustrated a cross-sectional view of the electrical terminal 10 taken along the line 2-2 of FIG. 1. The electrical terminal 10 includes two side walls 36 that extend from the terminal base 26 generally in the outbound direction 30 and are located on opposed sides of the terminal axis 12. Each side wall 36 extends from one of the crimp tongues 32 into the contact portion 16 of the electrical terminal 10.

The electrical terminal 10 also includes a wire hook 38. The illustrated wire hook 38 is part of the contact member 22, but may be part of any desired portion of the electrical terminal 10. The illustrated wire hook 38 is located between the connection portion 14 and the contact portion 16, but may be in any desired location on the electrical terminal 10.

The wire hook 38 includes a hook base 40 and a hook end 42. The hook base 40 is attached to one of the side walls 36 and extends from the side wall 36 in the outbound direction 30. The wire hook 38 is generally C-shaped and extends back toward the terminal base 26. The hook end 42 is located between the two side walls 36 spaced from the terminal base 26. In the illustrated embodiment, the hook end 42 is located proximate the terminal axis 12. However, the wire hook 38 may have any desired shape, and the hook end 42 may be in any desired location.

Figure 3:
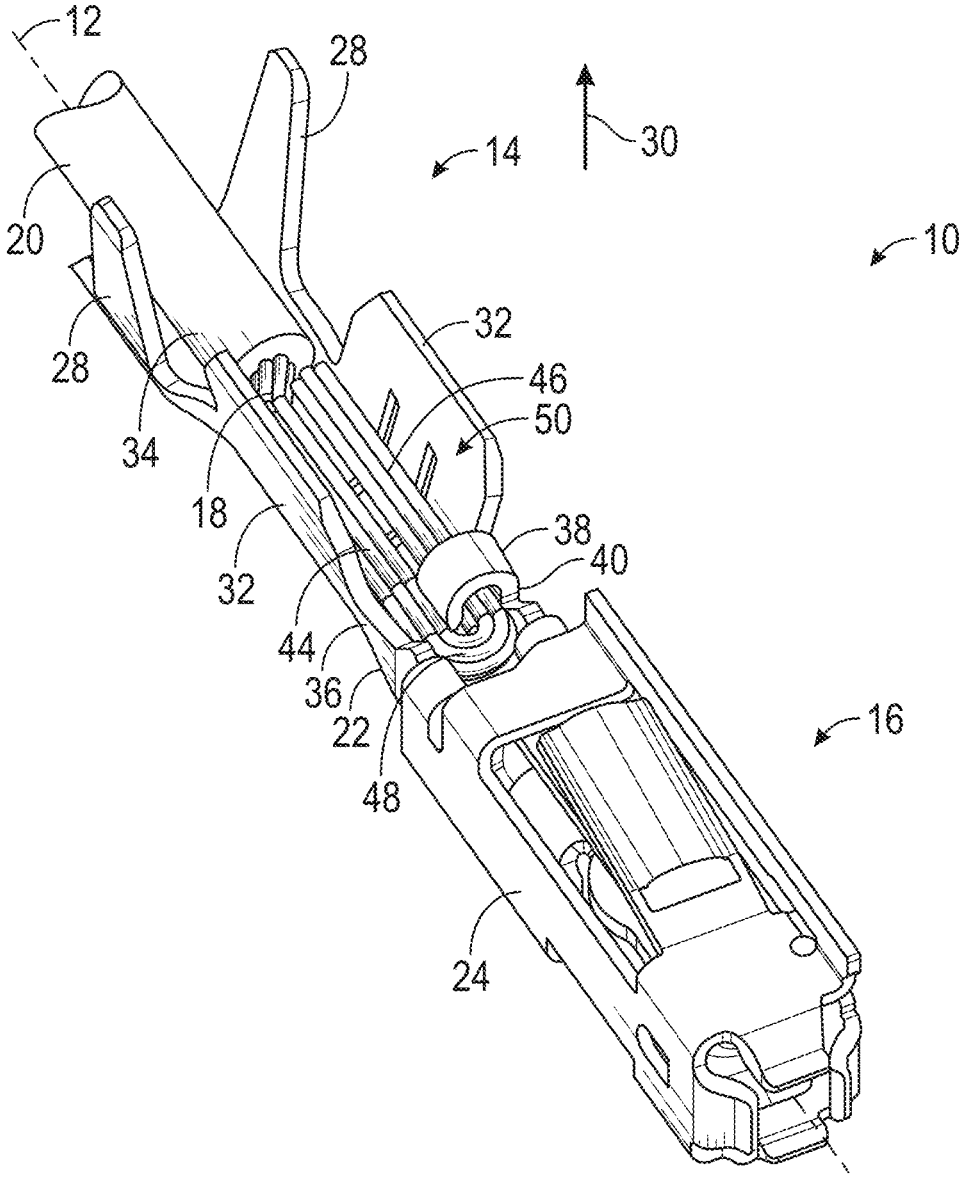
FIG. 3 is a perspective view similar to FIG. 1, showing the wire in a pre-crimp position relative to the electrical terminal.

Referring to FIG. 3, there is illustrated a view similar to FIG. 1, with the wire 20 shown positioned relative to the electrical terminal 10 in a pre-crimp position. As shown, part of the conductor 18 of the wire 20 is exposed where the insulator 34 has been removed. In the pre-crimp position, the wire 20 is located adjacent to the connection portion 14 so that a portion of the insulator 34 is located between the crimp tabs 28 and a portion of the conductor 18 is located between the crimp tongues 32. In the illustrated embodiment, the conductor 18 includes multiple strands of material, but may be any desired type of conductor.

The conductor 18 includes a first leg 44 and second leg 46 that are connected together by a bend 48. The first leg 44 extends through a conductor barrel, indicated generally at 50, that is located between the crimp tongues 32 to the bend 48. The second leg 46 extends from the bend 48 to the conductor barrel 50. In the illustrated embodiment, the bend 48 is a 180° bend in the conductor 18, and the first leg 44 and the second leg 46 are adjacent to each other and parallel to the terminal axis 12. However, the bend 48 may be any desired size, and the first leg 44 and the second leg 46 may have any desired orientations.

Figure 4:
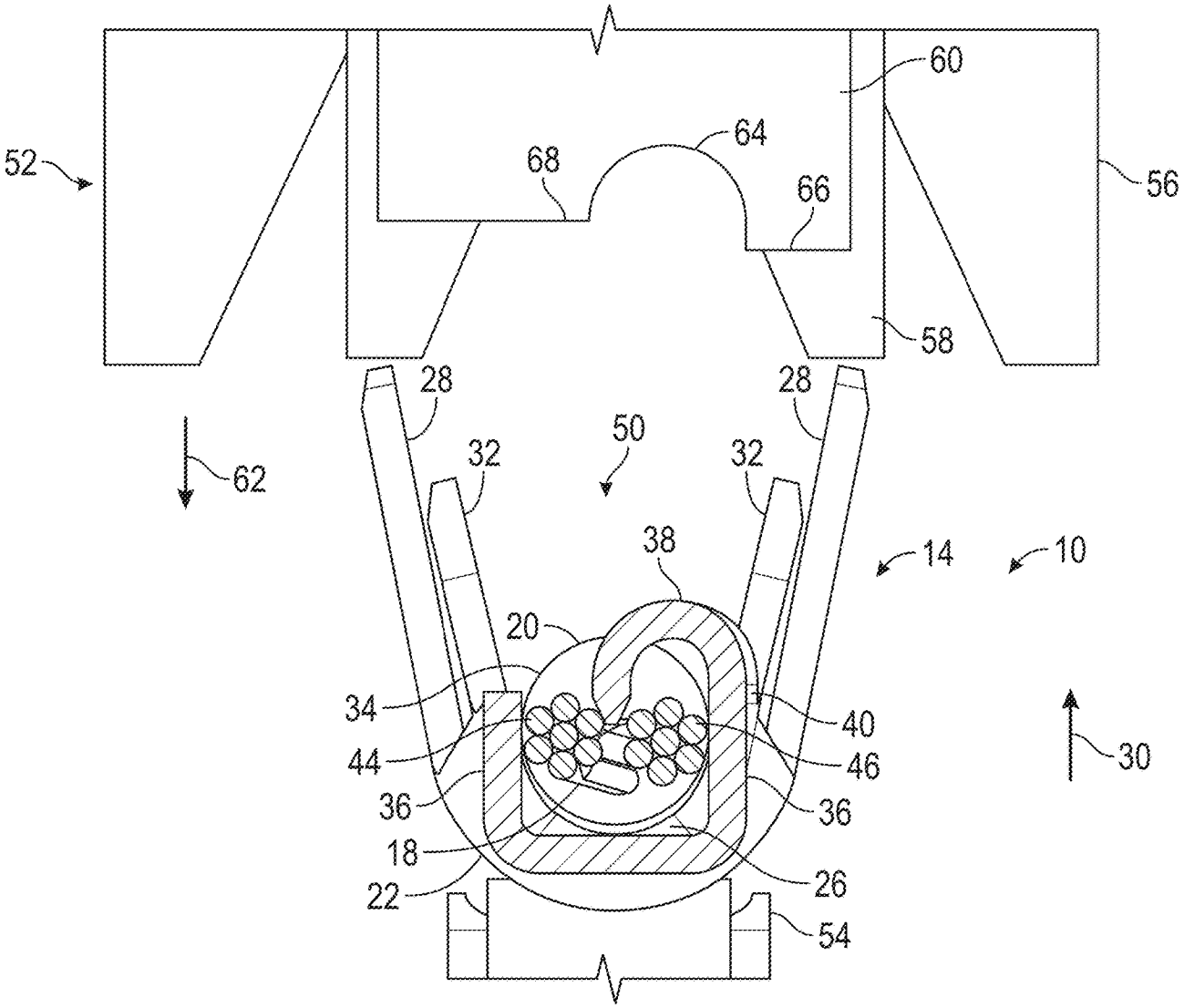
FIG. 4 is a cross-sectional view similar to FIG. 2, showing the wire in the pre-crimp position and the electrical terminal on a crimp die that is in an opened position.

Referring now to FIG. 4, there is illustrated a cross-sectional view similar to FIG. 2, showing the wire 20 in the pre-crimp position and the electrical terminal 10 located in a crimp tool, indicated generally at 52. The crimp tool 52 includes an anvil 54, an insulator die 56, a conductor die 58, and a hook die 60. The electrical terminal 10 is initially positioned on the anvil 54, with the terminal base 26 adjacent to the anvil 54. The dies 56, 58, and 60 are spaced apart from the anvil 54 in the outbound direction 30, with the electrical terminal 10 located therebetween. In order to crimp the electrical terminal 10 onto the wire 20, the dies 56, 58, and 60 are moved in a crimp direction 62 (which is opposite the outbound direction 30) toward the anvil 54. The insulator die 56 engages the crimp tabs 28 and bends the crimp tabs 28 to engage the insulator 34. Also, the conductor die 58 engages the crimp tongues 32 and bends the crimp tongues 32 to engage the conductor 18. Additionally, the hook die 60 engages the wire hook 38. The hook die 60 includes a hook guide 64 that defines a C-shaped curved inner surface.

Figure 5:
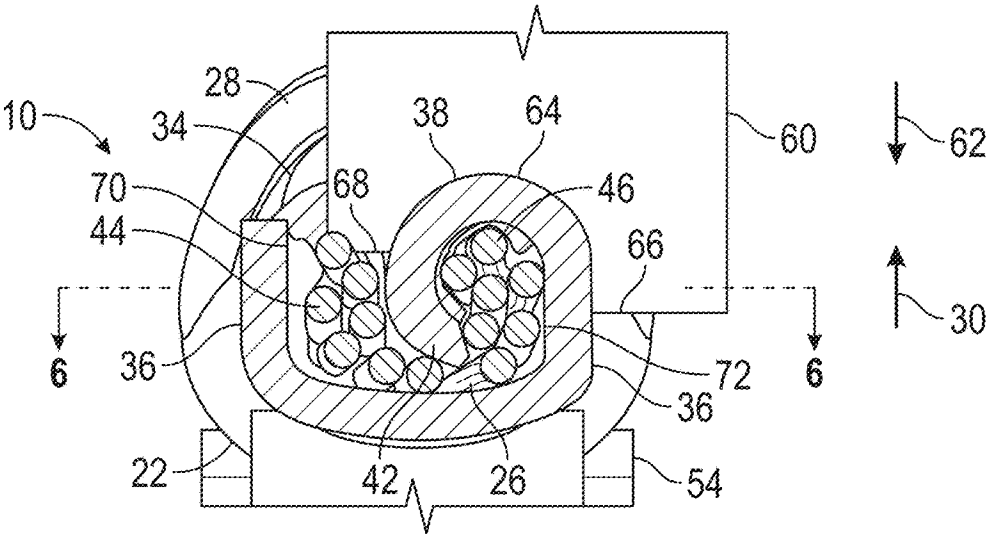
FIG. 5 is a cross-sectional view similar to FIG. 4, showing the crimp die in a closed position and the electrical terminal in a crimped position.

Referring to FIG. 5, there is illustrated a cross-sectional view similar to FIG. 4, showing the electrical terminal 10 in a crimped position. The hook die 60 is shown engaged with the wire hook 38. The hook guide 64 includes a base side 66, which is located adjacent to the hook base 40, and an end side 68, which is located adjacent to the hook end 42. The base side 66 extends farther in the crimp direction 62 than the end side 68. During the crimping process, the base side 66 is located adjacent to the side wall 36 that the hook base 40 is attached to and, thus, prevents it from deflecting away from the terminal axis 12. When the hook die 60 engages the wire hook 38, the hook end 42 is moved toward the terminal base 26. In the illustrated embodiment, the hook end 42 is also moved toward the side wall 36 that the hook base 40 is attached to and remains spaced from the terminal base 26.

Figure 6:
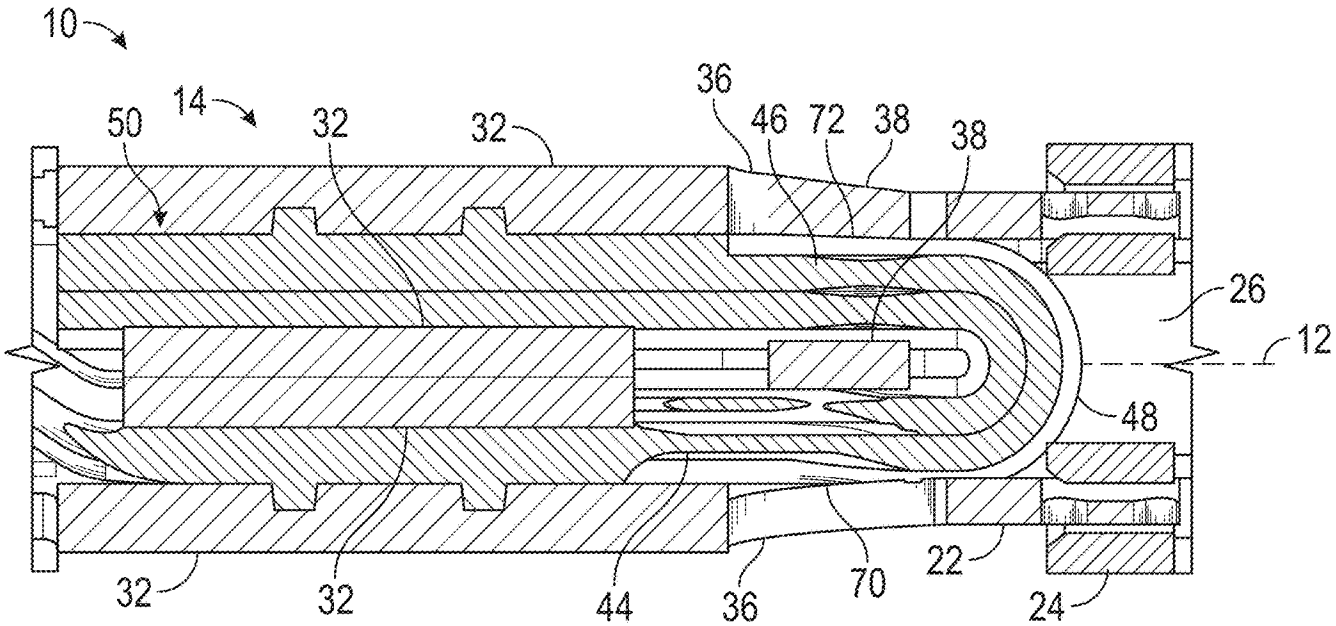
FIG. 6 is a cross-sectional view taken along the line 6-6 of FIG. 5 of the electrical terminal in the crimped position.

Referring to FIG. 6, there is illustrated a cross-sectional view taken along the line 6-6 of FIG. 5, showing the first leg 44 and the second leg 46 of the conductor 18. As previously described, the first leg 44 extends through the conductor barrel 50. During the crimping process, the crimp tongues 32 engage and deform the portion of the first leg 44 that is located in the conductor barrel 50. The first leg 44 extends from the conductor barrel 50 to the bend 48. The second leg 46 extends from the bend 48 to the conductor barrel 50. During the crimping process, the crimp tongues 32 also engage and deform the portion of the second leg 46 that is located in the conductor barrel 50.

The wire hook 38 is located between the bend 48 and the conductor barrel 50. The first leg 44 of the conductor 18 and the second leg 46 of the conductor 18 are located on opposed sides of the wire hook 38. As best shown in FIG. 5, during the crimping process, the wire hook 38 is bent and engages the conductor 18, but does not deform the strands of the conductor 18. This is different from the crimp tongues 32, which engage and deform portions of the conductor 18. However, the wire hook 38 may deform portions of the conductor 18, if desired.

After the electrical terminal 10 has been deformed to the crimped position, a force applied to the wire 20 to pull the wire 20 out of the electrical terminal 10 is resisted not only by the engagement of the crimp tabs 28 with the insulator 34 and the engagement of the crimp tongues 32 with the conductor 18, but additionally by the engagement of the wire hook 38 with the bend 48. Thus, the wire hook 38 increases the pull-out force that the electrical terminal 10 can resist.

As illustrated in FIGS. 4 and 5, the wire hook 38 extends between the side walls 36 of the electrical terminal 10 and divides a space between the side walls 36 into a first wire space 70 (between the wire hook 38 and one side wall 36) and a second wire space 72 (between the wire hook 38 and the other side wall 36). When the wire 20 is placed in the pre-crimp position in the electrical terminal 10 and the electrical terminal 10 is deflected to the crimped position, the first leg 44 of the conductor 18 is located in the first wire space 70, and the second leg 46 of the conductor 18 is located in the second wire space 72.

As best seen by comparing the pre-crimp position illustrated in FIG. 4 with the crimped position illustrated in FIG. 5, the hook end 42 is moved closer to the terminal base 26 during the crimping process. This is advantageous in that it provides a relatively large space for insertion of the conductor 18 in order to place the wire 20 in the pre-crimp position, while providing a relatively small space when the wire hook 38 is moved into the crimped position.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical terminal comprising:

a terminal base that includes:

first and second crimp tabs adapted to engage an insulator of a wire, first and second crimp tongues adapted to engage a conductor of the wire, first and second side walls that extend respectively from the terminal base separately and distinctly from the first and second crimp tabs and the first and second crimp tongues, and a wire hook that extends from one of the first and second side walls and between the first side wall and the second side wall so as to define (1) a first wire space between the wire hook and the first side wall and (2) a second wire space between the wire hook and the second side wall, the wire hook adapted to engage a bend in the wire; and a contact portion that extends from both of the first and second side walls and from the terminal base and is adapted to mate with a corresponding terminal.

2. The electrical terminal of claim 1, further including a wire having a first leg that extends through the first wire space, a second leg that extends through the second wire space, and a bend that extends between the first leg and the second leg.

3. The electrical terminal of claim 2, wherein the bend is disposed adjacent to the wire hook of the terminal base.

4. The electrical terminal of claim 2, wherein the first and second crimp tabs of the terminal base engage an insulator of the wire.

5. The electrical terminal of claim 4, wherein the first and second crimp tongues of the terminal base engage a conductor of the wire.

6. The electrical terminal of claim 2, wherein the first and second crimp tongues of the terminal base engage a conductor of the wire.

7. The electrical terminal of claim 6, wherein the bend is disposed adjacent to the wire hook of the terminal base.

* * * * *